US006125932A

United States Patent [19]

Hamid et al.

[11] Patent Number: 6,125,932

[45] Date of Patent: Oct. 3, 2000

[54] TORTUOUS PATH SAND CONTROL SCREEN AND METHOD FOR USE OF SAME

[75] Inventors: Syed Hamid; Ralph H. Echols, both of Dallas, Tex.

[73] Assignee: Halliburton Energy Services, Inc., Dallas, Tex.

[21] Appl. No.: 09/186,876

[22] Filed: Nov. 4, 1998

[51] Int. Cl.[7] ..... E21B 43/00

[52] U.S. Cl. ..... 166/233

[58] Field of Search ..... 166/56, 157, 228, 166/231, 233, 235, 276, 230

[56] References Cited

U.S. PATENT DOCUMENTS

| | | | |
|---|---|---|---|
| Re. 31,604 | 6/1984 | Bearden et al. | 166/232 |
| 713,544 | 11/1902 | Ware | 166/230 |
| 3,425,491 | 2/1969 | Zandmer | 166/205 |
| 3,584,685 | 6/1971 | Boyd | 166/231 |
| 3,709,293 | 1/1973 | Layne, II et al. | 166/232 |
| 4,299,283 | 11/1981 | Gryskiewicz | 166/231 |
| 4,821,800 | 4/1989 | Scott et al. | 166/228 |
| 5,095,990 | 3/1992 | Best et al. | 166/369 |
| 5,551,513 | 9/1996 | Surles et al. | 166/278 |
| 5,938,925 | 8/1999 | Hamid et al. | 210/497.1 |

*Primary Examiner*—David Bagnell
*Assistant Examiner*—Jennifer R Dougherty
*Attorney, Agent, or Firm*—William M. Imwalle; Lawrence R. Youst

[57] ABSTRACT

A tortuous path sand control screen (40) for reducing the velocity of particles (66) traveling therethrough is disclosed. The tortuous path sand control screen (40) comprises a base pipe (42) and a screen wire (48) wrapped therearound having turns (50, 52, 54) which extend along at least a portion of the length of the base pipe (42) forming gaps between adjacent turns (50, 52). The screen wire has a profile (62, 64) that reduces the velocity of the particles (66) traveling through the gaps, thereby minimizing erosion of the tortuous path sand control screen (40).

17 Claims, 5 Drawing Sheets

18
10
20
12
24
22
26
16
30
28
32
38
36
14
34

TORTUOUS PATH SAND CONTROL SCREEN AND METHOD FOR USE OF SAME

TECHNICAL FIELD OF THE INVENTION

This invention relates in general, to a sand control device used during the production of oil, gas or water, and in particular to, a sand control screen having a wire wrap with a profile that creates a tortuous path for particles and reduces particle velocity.

BACKGROUND OF THE INVENTION

Since the beginning of oil production from subsurface formations, the industry has been concerned with efficient control of the movement of unconsolidated formation particles, such as sand, into the wellbore. For example, such particle movement commonly occurs during production from completions in loose sandstone or following hydraulic fracture of a formation. Production of these materials causes numerous problems in the operation of oil, gas or water wells. These problems include plugging of formations, tubing and subsurface flow lines, as well as erosion of tubing, downhole equipment and surface equipment. These problems lead to high maintenance costs and unacceptable well downtime. Accordingly, numerous methods have been utilized to control the movement of unconsolidated particles during the production of fluids.

Gravel packing is one of the most common methods to prevent the production of sand. Generally, gravel packing involves placing pack sand, an aggregate or particulate material, in the annular space between the wellbore and a fluid permeable, perforated base pipe that is located adjacent to the production zone. A particular pack sand is selected to prevent the flow of formation particles therethrough, taking into consideration the characteristics of the particular reservoir. The perforated base pipe is designed to allow production fluids to flow therethrough with minimum resistance, while preventing both the pack sand and the formation particles from flowing into the production string. Gravel packing is commonly achieved by either an open hole gravel packing procedure or an internal gravel packing procedure, depending on the characteristics of the particular reservoir.

In addition to the use of a perforated base pipe and gravel packing, a sand control screen is commonly employed to control the movement of formation particles. These screens may comprise a continuous single wire wrapped around the base pipe. While this type of screen is capable of excluding even the smallest API grades of pack sand, these screens are easily damaged during handling, installation and production.

More recently, a sand control screen comprising a sand control screen jacket has been used. The screen jacket is fully formed from a single wire prior to attachment to the base pipe. Commonly, a plurality of ribs extend longitudinally along the internal surface of the screen jacket to provide strength to the wire and stand-off between the wire and the base pipe once the screen jacket is attached. In addition, some screen designs use prepacked sand confined around the perforated base pipe. These prepacked screens are constructed by fabricating the metal components, then forcing pack sand, either resin coated or uncoated, between the perforated base pipe and an inner wire screen or between an inner wire screen and an outer wire screen of a multilayer screen.

It has been found, however, that whether single or multilayer, conventional or prepacked, sand control screens are susceptible to erosion. This erosion process is particularly problematic during gravel packing, high rate water packing, or frac packing operations as well as during production. Erosion of the sand control screen may occur when fines are traveling through the screen at a sufficient velocity for a sufficient period of time. Thus, to control erosion, at least one of these three factors, fines, velocity or time must be eliminated.

Fines are defined as any particle that travels between the gaps in the sand control screen. The fines, however, must have a sufficient mass to cause damage. This critical mass occurs at roughly 50 microns. Also, the fines must be traveling at a high enough velocity in order to have the kinetic energy necessary to dislodge particles of metal as the fines impinge the sand control screen surface. Along with high velocity fines, the erosion process requires time in order to damage the sand control screen. In as little as two minutes, however, high velocity fines can damage a sand control screen to the extent that a typical 40/60 or 50/70 pack sand can travel through the eroded area of the sand control screen into the production string with virtually no resistance.

Therefore, a need has arisen for a sand control screen apparatus for filtering particles out of fluid produced from a wellbore that will not erode during gravel packing, high rate water packing, frac packing, or production and that is capable of withstanding severe downhole conditions during installation and production.

SUMMARY OF THE INVENTION

The present invention disclosed herein comprises a tortuous path sand control screen for filtering particles out of fluid produced from a wellbore that is capable of withstanding severe downhole conditions during installation and production and that experiences low rates of erosion during gravel packing, high rate water packing, frac packing or production.

The tortuous path sand control screen of the present invention comprises a base pipe and a screen wire wrapped around the base pipe such that the turns of the screen wire extend along at least a portion of the length of the base pipe and form gaps therebetween. The screen wire has a profile that reduces the velocity of particles traveling through the gaps. The profile of the screen wire channels the particles in a nonlinear path which causes the particles to loose energy and velocity. For example, the profile of the screen wire may channel the particles in an arcuate path. Alternatively, the profile of the screen wire may channel the particles in a multi-arcuate path.

The tortuous path sand control screen of the present invention provides for self cleaning as the width of the gaps progressively increases from the entry gap width to the exit gap width. For example, the entry gap width may be between about 0.006 inches and 0.020 inches, while the exit gap width may be between about 0.040 inches and 0.080 inches.

In operation, the tortuous path sand control screen of the present invention is disposed about a base pipe having opening through which formation fluids are produced. The base pipe is typically attached to the production tubing as part of the final bottom hole assembly.

In the method of the present invention, the velocity of particles traveling through a sand control screen is reduced by positioning the sand control screen in the path of formation fluids having suspended particles therein and passing the particles through gaps between adjacent turns of screen wire. The profile of the screen wire reduces the velocity of the particle traveling through the sand control screen. This is achieved by channeling the particles in a nonlinear path, such as an arcuate path or a multi-arcuate path.

BRIEF DESCRIPTION OF THE DRAWINGS

For a more complete understanding of the present invention, including its features and advantages, reference is now made to the detailed description of the invention, taken in conjunction with the accompanying drawings in which like numerals identify like parts and in which.

DETAILED DESCRIPTION OF THE INVENTION

While the making and using of various embodiments of the present invention is discussed in detail below, it should be appreciated that the present invention provides many applicable inventive concepts which can be embodied in a wide variety of specific contexts. The specific embodiments discussed herein are merely illustrative of specific ways to make and use the invention, and do not limit the scope of the invention.

Figure 1:
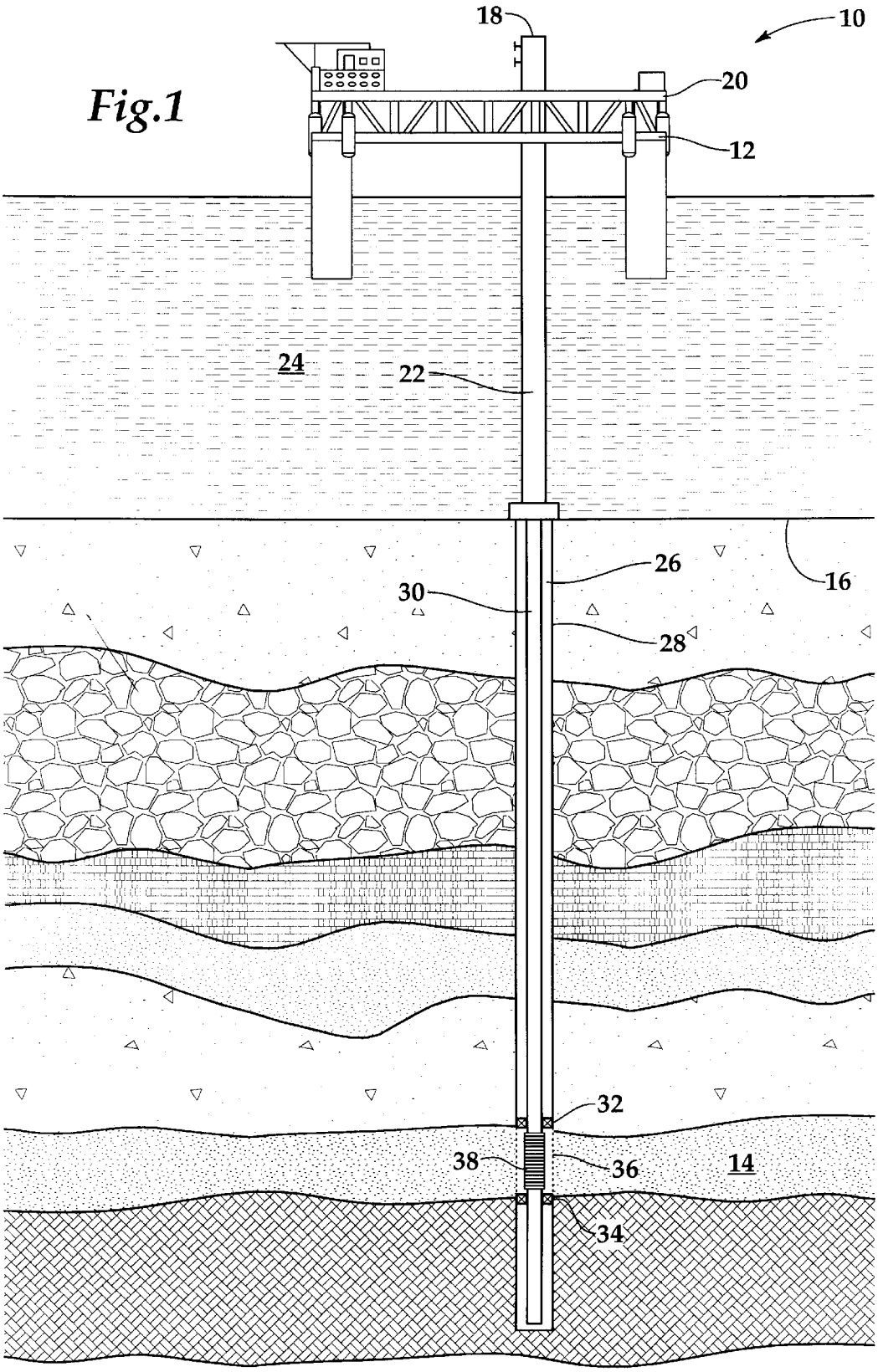
FIG. 1 is a schematic illustration of an offshore production platform operating a tortuous path sand control screen of the present invention.

Referring to FIG. 1, a tortuous path sand control screen in use with an offshore oil and gas production platform is schematically illustrated and generally designated 10. A semi-submersible platform 12 is centered over a submerged oil and gas formation 14 located below sea floor 16. Wellhead 18 is located on deck 20 of platform 12. Well 22 extends through the sea 24 and penetrates the various earth strata including formation 14 to form wellbore 26. Disposed within wellbore 26 is casing 28. Disposed within casing 28 and extending from wellhead 18 is production tubing 30. A pair of seal assemblies 32, 34 provide a seal between tubing 30 and casing 28 to prevent the flow of production fluids therebetween. During production, formation fluids enter wellbore 26 through perforations 36 of casing 28 and travel into tubing 30 to wellhead 18. As part of the final bottom hole assembly, a tortuous path sand control screen 38 is included within tubing 30. Tortuous path sand control screen 38 filters the particles out of the formation fluids as the formation fluids are produced.

Even though FIG. 1 depicts a cased vertical well, it should be noted by one skilled in the art that the tortuous path sand control screen of the present invention is equally well-suited for uncased wells, deviated wells or horizontal wells.

Figure 2:
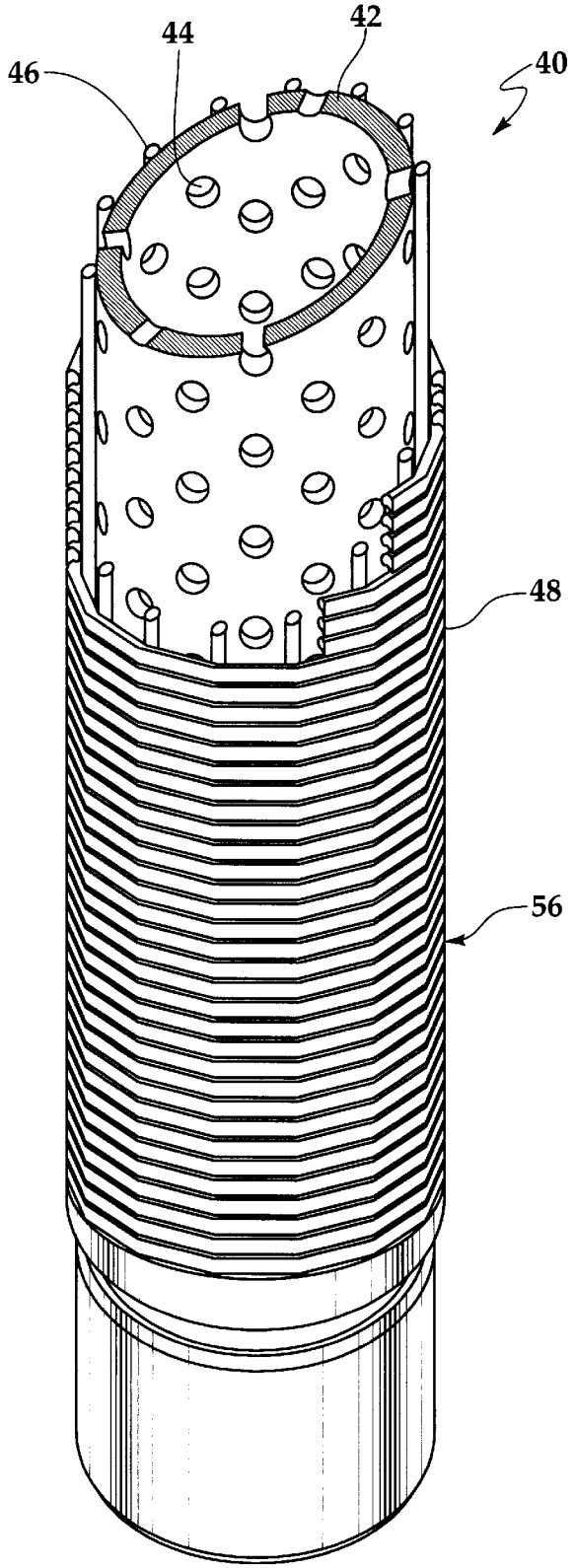
FIG. 2 is a side elevation, partially cut away, of a tortuous path sand control screen of the present invention.
Figure 3:
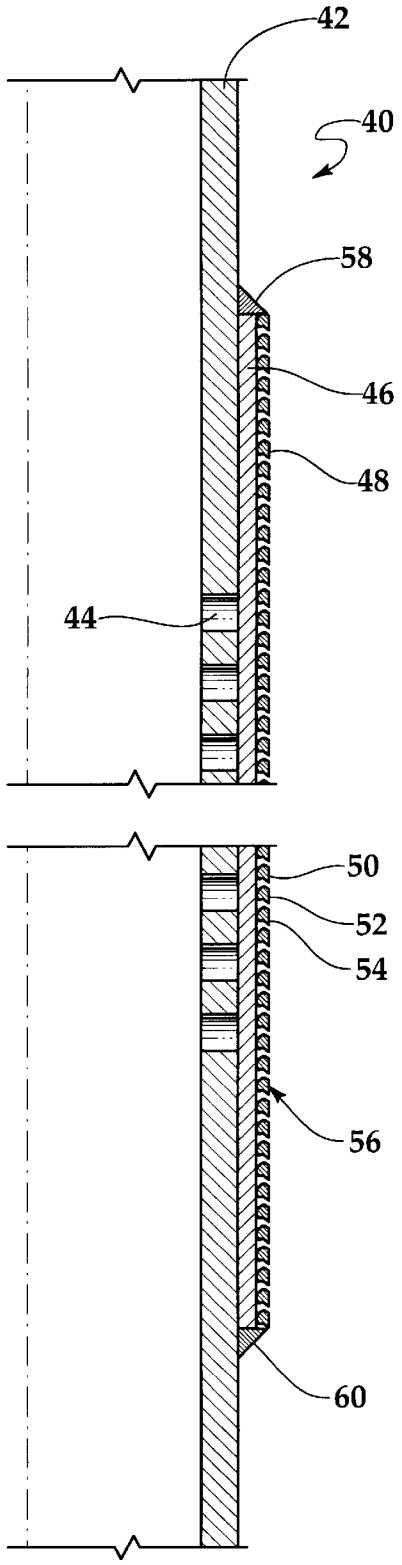
FIG. 3 is a cross sectional view of a tortuous path sand control screen of the present invention.

Referring to FIGS. 2 and 3, one embodiment of a tortuous path sand control screen is depicted and generally designated 40. Sand control screen 40 includes a base pipe 42 that has a plurality of openings 44 which allow the flow of production fluids into the production tubing. The number, size and shape of openings 44 are not critical to the present invention, so long as sufficient area is provided for fluid production and pipe integrity is maintained.

Spaced around base pipe 42 is a plurality of ribs 46. Ribs 46 are generally symmetrically distributed about the axis of base pipe 42. Ribs 46 are depicted as having a cylindrical cross section, however, it should be understood by one skilled in the art that ribs 46 may alternatively have a rectangular or triangular cross section or other suitable geometry. Additionally, it should be understood by one skilled in the art that the exact number of ribs 46 will be dependent upon the diameter of base pipe 42 as well as other design characteristics that are well known in the art.

Wrapped around ribs 46 is a screen wire 48. Screen wire 48 forms a plurality of turns, such as turn 50, turn 52 and turn 54. Between each of the turns is a gap through which formation fluids flow. The number of turns and the gap between the turns are determined based upon the characteristics of the formation from which fluid is being produced. Together, ribs 46 and screen wire 48 form a sand control screen jacket 56 which is attached to base pipe 42 at its upper end by weld 58 and its lower end by weld 60. Screen wire 48 may be constructed from material such as 304 stainless steel, 316 stainless steel, Hastelloy, Inconel or Monel.

Even though FIG. 3 depicts sand control screen jacket 56 as being welded to base pipe 42, it should be understood by one skilled in the art that sand control screen jacket 56 may be attached to base pipe 42 in a variety of ways including, but not limited to, suitable mechanical methods. Also, it should be understood by one skilled in the art that while ribs 46 are depicted in FIGS. 2 and 3, a wire mesh may alternatively be disposed between base pipe 42 and screen wire 48 or screen wire 48 may be wrapped directly around base pipe 42.

Figure 4:
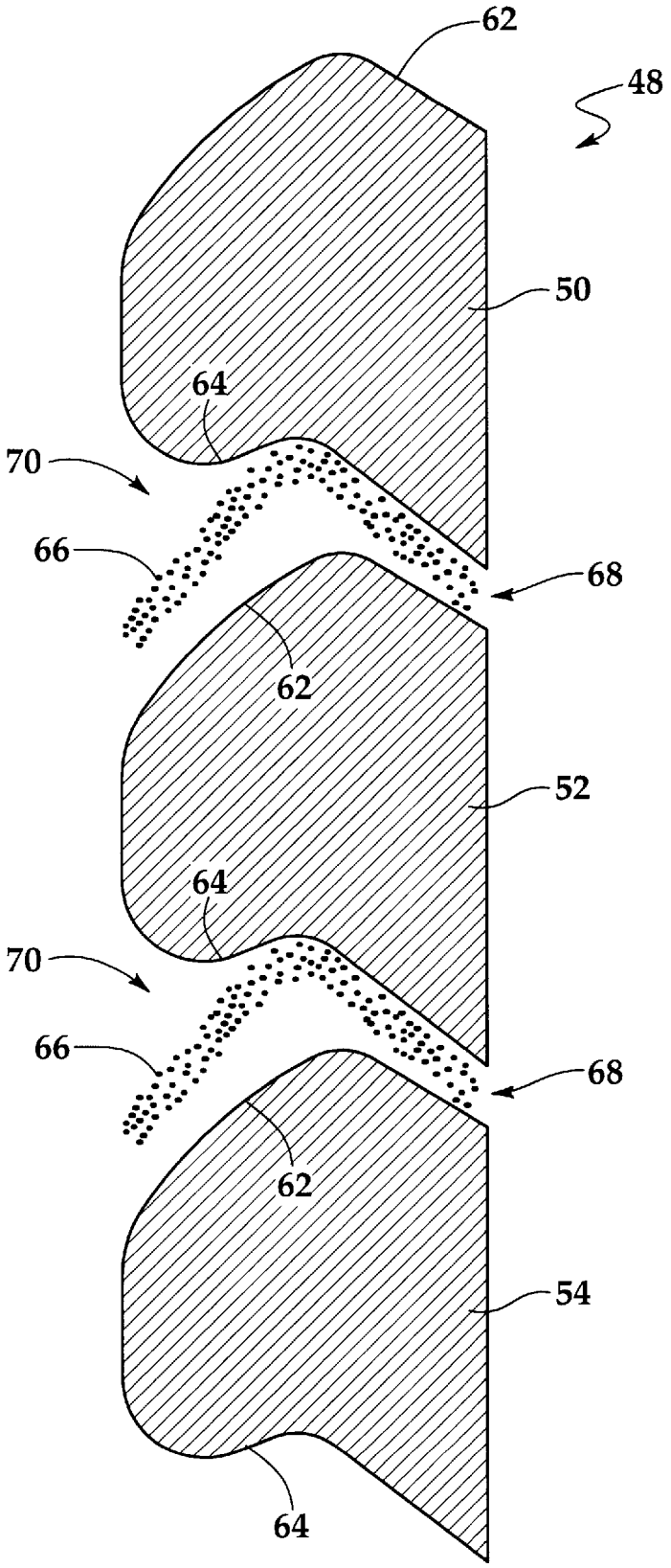
FIG. 4 is an enlarged view of adjacent turns of screen wire of a tortuous path sand control screen of the present invention.

As best seen in FIG. 4, turns 50, 52 and 54 of screen wire 48 each have an upper profile 62 and a lower profile 64. As the upper profile 62 of one turn is placed adjacent to the lower profile 64 of another turn, a tortuous path is created for the formation fluids and particles traveling therethrough. For example, when the formation fluids travel between turn 50 and turn 52 of screen wire 48, the velocity of particles 66 is selectively reduced due to the inertia of particles 66. Initially, particles 66 move upwardly toward lower profile 64 of turn 50. Thereafter, particles 66 move downwardly toward upper profile 62 of turn 52. In a similar manner, when the formation fluids travel between turn 52 and turn 54 of screen wire 48, the velocity of particles 66 is selectively reduced as particles 66 initially move upwardly toward lower profile 64 of turn 52 and then move downwardly toward upper profile 62 of turn 54.

The tortuous path created by upper profile 62 and lower profile 64 of adjacent turns causes particles 66 to travel in a nonlinear path. In the illustrated embodiment, particles 66 are required to travel in an arcuate path which causes particles 66 to loose energy and velocity. Thus, as particles 66 travel through the tortuous path created by upper profile 62 and lower profile 64 of adjacent turns, the ability of particles 66 to erode screen wire 48 as well as other metal components of tortuous path sand control screen 40 is reduced. In addition, tortuous path sand control screen 40 of the present invention includes a self cleaning feature that minimizes the potential for clogs between adjacent turns. Specifically, the gap width between adjacent turns progressively increases from the entry gap width 68 to the exit gap width 70. As an example, entry gap width 68 may be between about 0.006 inches and 0.020 inches while exit gap width 70 may be between about 0.040 inches and 0.080 inches.

It should be apparent to those skilled in the art that the specified dimensions are only exemplary of suitable widths for entry gap width 68 and exit gap width 70. Other widths, both larger and smaller, would also be suitable depending upon the size of particles 66. It should also be apparent to those skilled in the art that the use of directional terms such as above, below, upper, lower, upward, downward, etc. are used in relation to the illustrative embodiments as they are depicted in the figures, the upward direction being towards the top of the corresponding figure and the downward direction being toward the bottom of the corresponding figure. It is to be understood that tortuous path sand control screen 40 of the present invention may be operated in vertical, horizontal, inverted or inclined orientations without deviating from the principles of the present invention.

Figure 5:
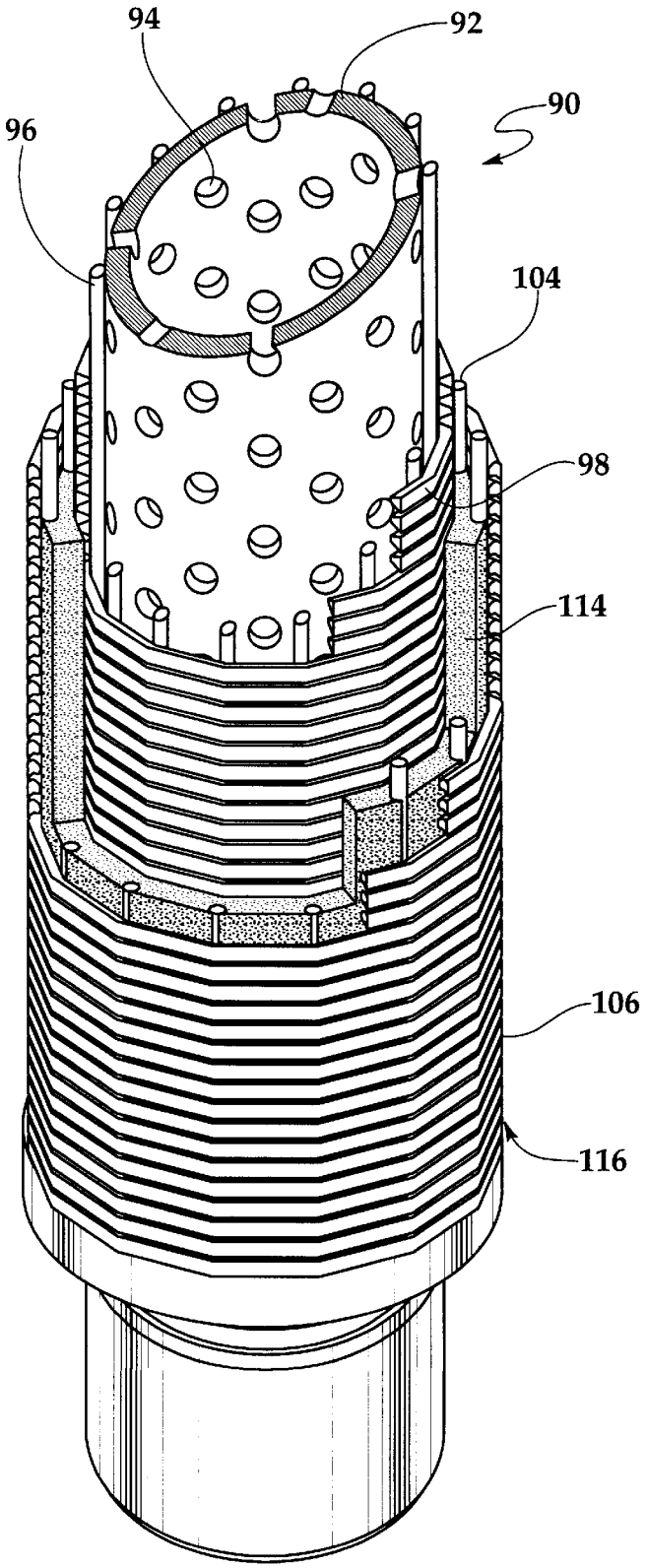
FIG. 5 is a side elevation, partially cut away, of a tortuous path sand control screen of the present invention.
Figure 6:
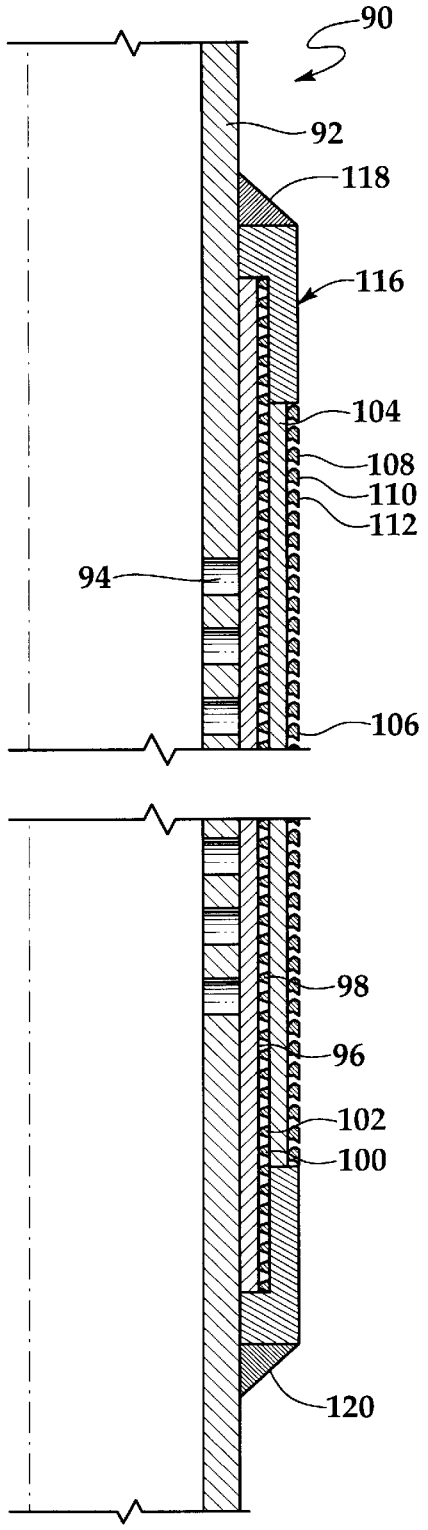
FIG. 6 is a cross sectional view of a tortuous path sand control screen of the present invention.

Referring now to FIGS. 5 and 6, another embodiment of a tortuous path sand control screen is depicted and generally designated 90. Tortuous path sand control screen 90 includes a base pipe 92 having a plurality of openings 94. Tortuous path sand control screen 90 also includes a plurality of ribs 96 that are symmetrically positioned about the axis of base pipe 92. A screen wire 98 is wrapped around ribs 96 forming adjacent turns such as turns 100, 102 having gaps therebetween. Symmetrically positioned about screen wire 98 is a plurality of ribs 104. Wrapped around ribs 104 is a screen wire 106 that forms a plurality of turns such as turns 108, 110, 112 having gaps therebetween. Disposed in the annular area between screen wire 98 and screen wire 106 is a prepack sand 114. Prepack sand 114 may be resin-coated and baked in place. Together, ribs 96, screen wire 98, prepack sand 114, ribs 104 and screen wire 106 form sand control screen jacket 116. Sand control screen jacket 116 is attached to base pipe 92 at its upper end by weld 118 and its lower end by weld 120.

Figure 7:
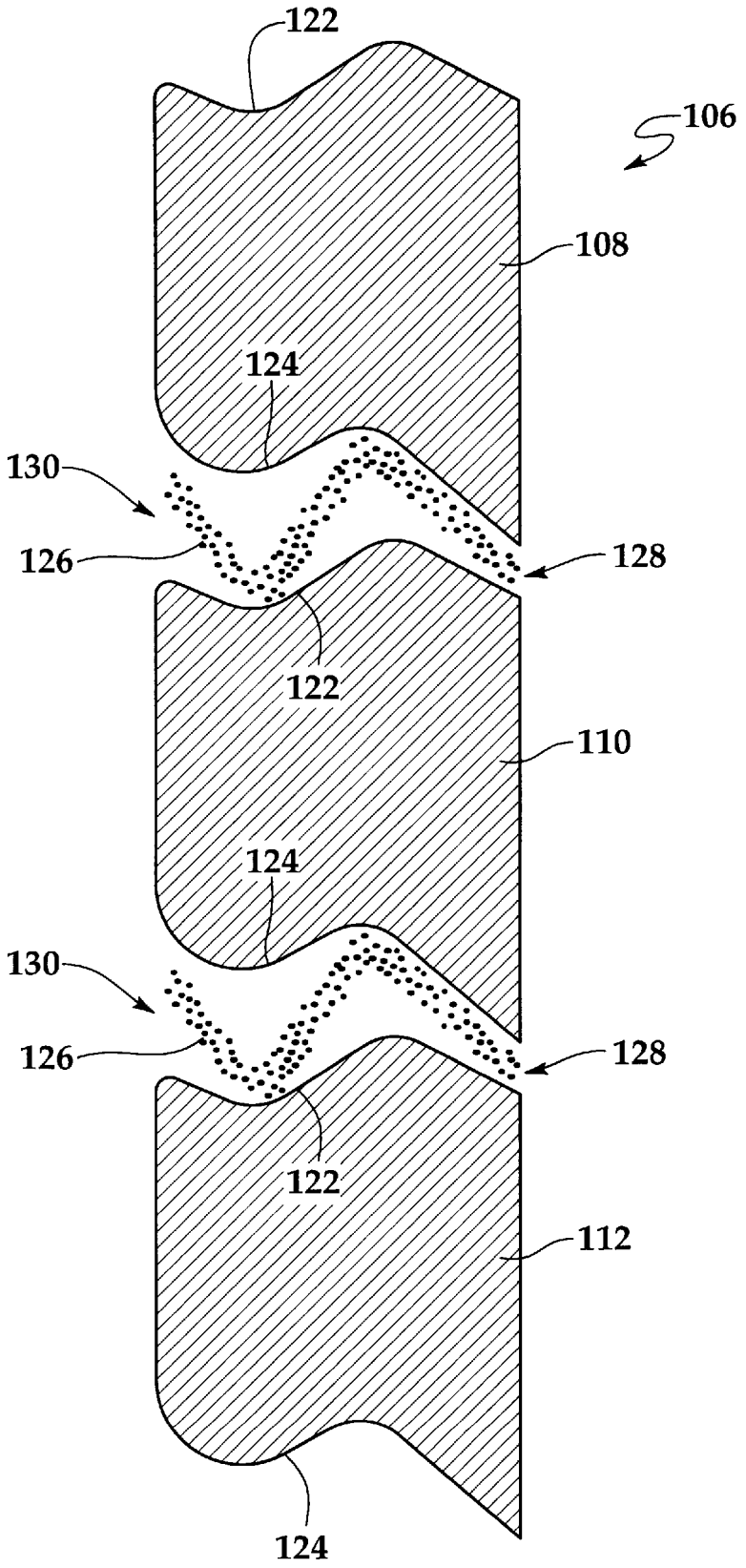
FIG. 7 is an enlarged view of adjacent turns of screen wire of a tortuous path sand control screen of the present invention.

As best seen in FIG. 7, turns 108, 110 and 112 of screen wire 106 each have an upper profile 122 and a lower profile 124. As the upper profile 122 of one turn is placed adjacent to the lower profile 124 of another turn, a tortuous path is created for the formation fluids and particles traveling therethrough. For example, when the formation fluids travel between turn 108 and turn 110 of screen wire 106, the velocity of particles 126 is selectively reduced due to the inertia of particles 126. Initially, particles 126 move upwardly toward lower profile 124 of turn 108. Then, particles 126 move downwardly toward upper profile 122 of turn 110. Thereafter, particles 126 again move upwardly toward lower profile 124 of turn 108. In a similar manner, when the formation fluids travel between turn 110 and turn 112 of screen wire 106, the velocity of particles 126 is selectively reduced as particles 126 initially move upwardly toward lower profile 124 of turn 110, then move downwardly toward upper profile 122 of turn 112 and then move upwardly toward lower profile 124 of turn 110.

The tortuous path created by upper profile 122 and lower profile 124 of adjacent turns causes particles 126 to travel in a nonlinear path. In the illustrated embodiment, particles 126 travel in a multi-arcuate path which causes particles 126 to loose energy and velocity. Thus, as particles 126 travel through the tortuous path created by upper profile 122 and lower profile 124 of adjacent turns, the ability of particles 126 to erode screen wire 106 as well as other metal components of tortuous path sand control screen 90 is reduced. In addition, tortuous path sand control screen 90 of the present invention is self cleaning as the gap width between adjacent turns progressively increases from the entry gap width 128 to the exit gap width 130.

As erosion of the inner screen wire 98 is typically not an issue, a conventional keystone shaped screen wire has been depicted in FIGS. 5 and 6. Nonetheless, it should be apparent that screen wire 98 could also utilize an upper profile and lower profile such as upper profile 122 and lower profile 124 to prevent possible erosion problems.

While this invention has been described with a reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A sand control screen comprising:

a base pipe; and a screen wire having a general cross-sectional shape comprising a first substantially linear segment, a second substantially liner segment that is shorter than and substantially parallel to the first segment, a third segment extending between one end of the first segment and one end of the second segment, the third segment having a substantially convex arcuate shape and a fourth segment extending between the other end of the first segment and the other end of the second segment, the fourth segment having a substantially concave arcuate shape, the screen wire wrapped around the base pipe forming turns which extend along at least part of the length of the base pipe such that the third segment of the screen wire of one turn is adjacent to the fourth segment of the screen wire of the next turn, thereby forming gaps that reduce the velocity of particles traveling therethrough.

2. The sand control screen as recited in claim 1 wherein the gaps channel the particles in a nonlinear path.

3. The sand control screen as recited in claim 1 wherein the gaps channel the particles in an arcuate path.

4. The sand control screen as recited in claim 1 wherein the gaps further comprise an entry gap width and an exit gap width, the exit gap width being greater than the entry gap width.

5. The sand control screen as recited in claim 4 wherein the entry gap width is between about 0.006 inches and 0.020 inches.

6. The sand control screen as recited in claim 1 further comprising a plurality of ribs disposed between the base pipe and the screen wire.

7. A sand control screen comprising:

a base pipe; and a screen wire having a general cross-sectional shape comprising a first substantially linear segment, a second substantially liner segment that is shorter than and substantially parallel to the first segment, a third segment extending between one end of the first segment and one end of the second segment, the third segment having a multi-arcuate shape having a convex section and a concave section and a fourth segment extending between the other end of the first segment and the other end of the second segment, the fourth segment having a multi-arcuate shape having a convex section and a concave section, the screen wire wrapped around the base pipe forming turns which extend along at least part of the length of the base pipe such that the third segment of the screen wire of one turn is adjacent to the fourth segment of the screen wire of the next turn, thereby forming gaps that reduce the velocity of particles traveling therethrough.

8. The sand control screen as recited in claim 7 wherein the gaps channel the particles in a nonlinear path.

9. The sand control screen as recited in claim 7 wherein the gaps channel the particles in a multi-arcuate path.

10. The sand control screen as recited in claim 7 wherein the gaps further comprise an entry gap width and an exit gap width, the exit gap width being greater than the entry gap width.

11. The sand control screen as recited in claim 10 wherein the entry gap width is between about 0.006 inches and 0.020 inches.

12. The sand control screen as recited in claim 7 further comprising a plurality of ribs disposed between the base pipe and the screen wire.

13. A method for reducing the velocity of particles traveling through a sand control screen, the sand control screen including a base pipe and screen wire, the screen wire having a general cross-sectional shape comprising a first substantially linear segment, a second substantially liner segment that is shorter than and substantially parallel to the first segment, a third segment extending between one end of the first segment and one end of the second segment, the third segment having a substantially convex arcuate shape and a fourth segment extending between the other end of the first segment and the other end of the second segment, the fourth segment having a substantially concave arcuate shape, the screen wire wrapped around the base pipe forming turns which extend along at least part of the length of the base pipe such that the third segment of the screen wire of one turn is adjacent to the fourth segment of the screen wire of the next turn, thereby forming gaps, the method comprising the steps of:

positioning the sand control screen in a fluid having suspended particles therein; and passing the particles through the gaps between the adjacent turns of the screen wire, thereby reducing the velocity of the particle traveling through the sand control screen.

14. The method as recited in claim 13 wherein the step of passing the particles through the gaps between the adjacent turns of the screen wire further comprises channeling the particles in a nonlinear path.

15. The method as recited in claim 13 wherein the step of passing the particles through the gaps between the adjacent turns of the screen wire further comprises channeling the particles in an arcuate path.

16. The method as recited in claim 13 further comprising the step of progressively enlarging the gap width between an entry gap width and an exit gap width, thereby self cleaning the sand control screen.

17. The method as recited in claim 16 wherein the entry gap width is between about 0.006 inches and 0.020 inches.

* * * * *